United States Patent [19]

Lenkoff

[11] 4,212,393

[45] Jul. 15, 1980

[54] MAGIC PICTURES

[76] Inventor: Leon G. Lenkoff, 3203 Alden Dell, Louisville, Ky. 40207

[21] Appl. No.: 974,520

[22] Filed: Dec. 29, 1978

[51] Int. Cl.[2] ..... B44D 5/06

[52] U.S. Cl. ..... 206/575; 35/26; 401/198

[58] Field of Search ..... 35/9 G, 26, 36; 206/575; 401/198-199; 281/1 R

[56] References Cited

U.S. PATENT DOCUMENTS

| | | | |
|---|---|---|---|
| 3,454,344 | 7/1969 | Ryan et al. | 35/9 G X |
| 3,745,672 | 7/1973 | Duskin | 401/198 X |
| 3,826,499 | 7/1974 | Lenkoff | 35/9 G X |

FOREIGN PATENT DOCUMENTS

| | | | |
|---|---|---|---|
| 2030207 | 12/1971 | Fed. Rep. of Germany | 35/9 G |
| 957670 | 5/1964 | United Kingdom | 35/26 |

*Primary Examiner*—Herbert F. Ross

*Attorney, Agent, or Firm*—Wenderoth, Lind & Ponack

[57] ABSTRACT

The present invention relates to a "magic" coloring package combination consisting of magic pictures and a felt tip marker pen filled with water or containing a water solution therein. These magic or invisible coloring pictures consist of printed papers which have various figures outlined in a dark color, e.g. black, wherein the space within the figure is printed with a uniform water insoluble ink including therein one or more latent water soluble coloring materials which may be printed in a pattern of dots. When the insoluble imprints of ink are contacted by the felt tip, the water in the pen is deposited on the paper and releases the latent coloring material, thereby spreading it on the adjacent locality of the paper. This magic coloring combination is designed to be used by a small child on a trip, e.g. airplane ride or a car, where water is either unavailable and/or would be too messy to utilize. The present invention also relates to a felt tip pen filled with or containing a water solution and designed to activate the latent coloring materials on a so-called "magic" picture.

11 Claims, 2 Drawing Figures

MAGIC PICTURES

BACKGROUND OF THE INVENTION

A. Field of the Invention

The present invention relates to a magic coloring package combination consisting of a water filled felt tip marker pen in combination with printed papers which have various figures outlined in a dark color, such as black, wherein the space within the figures are printed with a pattern of dots of a uniform color insoluble ink containing therein one or more various latent water-soluble coloring materials (hereinafter referred to in the singular as "material" in certain instances for the sake of simplicity, it being understood that the single figure may contain a variety of different colors and intensities). When the insoluble imprints of ink are contacted by water, the latent coloring material is released and spread upon the paper.

The present invention also relates to a felt tip marker pen which is composed of a tubular hollow holder portion closed at one end and containing a felt tip at the other end, said hollow portion containing a water solution therein, preferably composed of water and a water evaporation inhibitor. This pen is designed to be used to activate said hidden picture by releasing the latent coloring material by means of the water within the pen housing.

B. Description of the Prior Art

Up to the present time, it has been known to use magic pictures consisting of a line drawing of a figure with separate areas inside of the lines coated with an invisible coloring substance which, when activated by water, turns into a distinguishable color by the application of water thereto. This is effected by applying water to a figure containing the invisible coloring substance by means of an applicator, such as a brush, from an external water supply. This typical system has various disadvantages. Firstly, in order for a child to carry out this "magic" coloring process, an external source of water is necessary, such as a basin of water, which is cumbersome and usually results in the necessity of using the magic coloring picture-applicator combination in a home or a place where the external source of water can be conveniently supplied. Further, this coloring procedure is messy in that water applied from the basin or other receptacle is usually splashed all over the coloring book as well as the floor, etc. These disadvantages greatly limit the use of such magic picture coloring combinations.

SUMMARY OF THE INVENTION

The present invention overcomes the disadvantages of the prior art by supplying a magic coloring package combination consisting of a water filled felt tip marker pen packaged with magic pictures printed on papers or in a coloring book, thereby making it unnecessary to use an external water source. This makes it possible for a child to use the magic coloring package combination on trips, such as automobile rides or airplanes, where the source of water is not readily available and/or, if available, would be too messy to use.

The present invention also involves the said water filled felt tip marker pen per se for use on a magic coloring picture.

DESCRIPTION OF THE PREFERRED EMBODIMENTS

Figure 1:
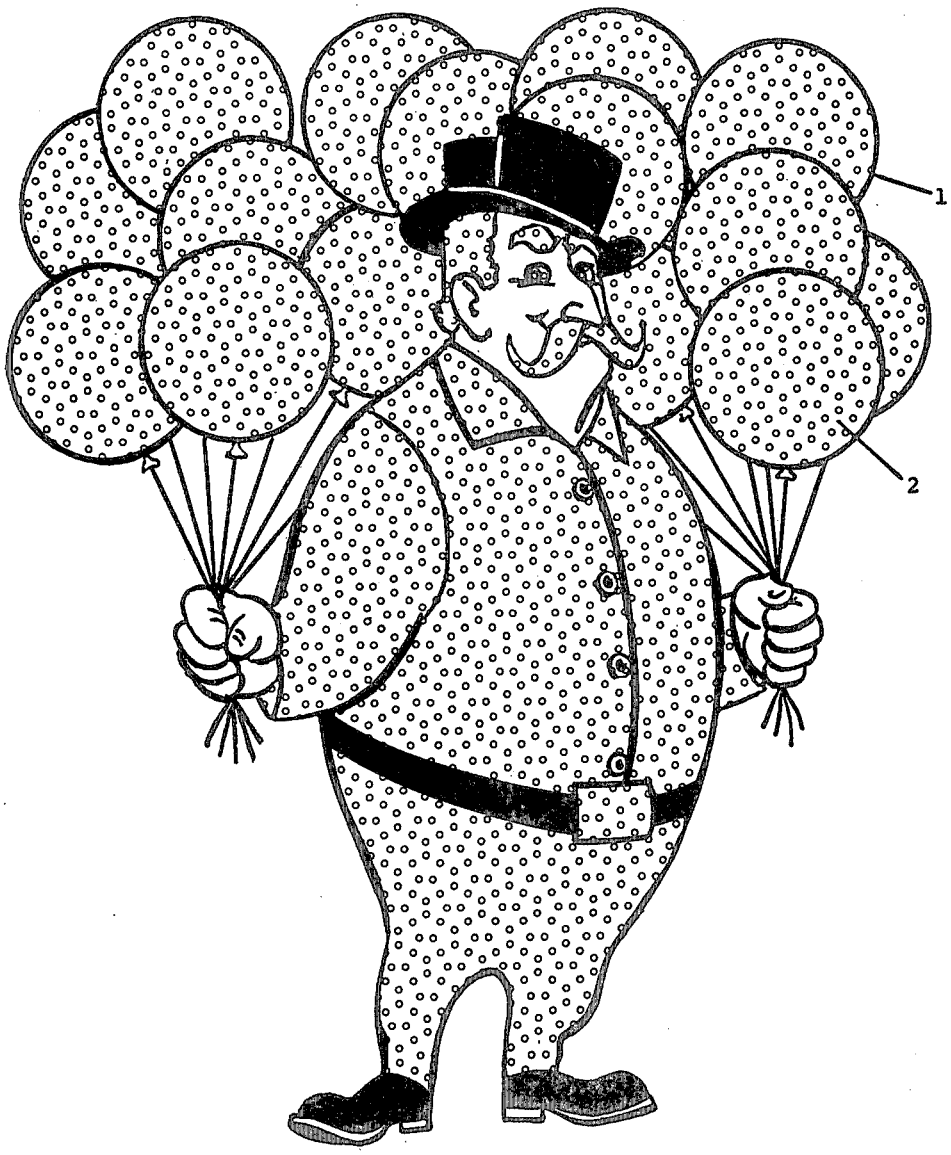
FIG. 1 is a typical cartoon-like figure containing an invisible coloring substance in the dotted area of the figure.

The present invention also relates to a package combination consisting of a felt tip marker pen filled with a solution of water in combination with magic pictures. These magic pictures are printed on papers having figures printed thereon outlined in a dark color, such as black, and containing separate areas inside of the lines activated by rubbing the said marker thereover, thereby turning these areas into distinguishable colors. A transformation of colors might be considered as "magic" by a small child utilizing the felt tip marker, since both the substance within the drawing and the solution contained in the marker are colorless. Furthermore, a perfect picture is possible each time, since the coloring compounds are only within the specific line areas and the metered water spreads the color only to the adjacent area where the water is deposited from the felt tip pen. Thus, there is very little possibility for the activated coloring substance within the lines to run outside the lines.

The manner of producing such pictures made of invisible color combinations which, upon activation by a solvent, releases the disguised colors is well known. See particularly the Imhof patents, U.S. Pat. Nos. 1,384,663 and 1,507,358, which patents generally describe how the artist makes the coloring pictures. Thus, in preparing the picture, the artist makes separate drawings of the various colors, such as blue, yellow and red partial images; however, these drawings are made in black or a uniform color and are produced by means of photoengraving and made into halftone plates or their equivalent. The separate impressions are then superimposed on the same surface, resulting in the total picture to be produced. In printing the several partial images, soluble aniline colors are ground in, or otherwise thoroughly mixed with an insoluble ink of uniform color. When the mixed material is printed, the detection of the latent color is practically impossible, but when water is spread over the ink, the water-soluble aniline color is dissolved and spreads over the picture in the adjacent locality to produce colored areas. A more detailed description is set forth in the aforementioned patents, the teachings of which are incorporated by reference herein.

Referring to FIG. 1 of the instant drawings, this figure represents a cartoon-like character holding various balloons which upon activation with water or water solution, magically turns the various outlined dotted areas into a variety of different colors depending on the nature of the water soluble colors admixed with the water insoluble ink of uniform color in the dotted areas. Also, different intensities of the same colors can be produced by varying the concentration of the water soluble color with the water-insoluble ink. According to FIG. 1, the numeral 1 represents a dark outline made of an insoluble ink which serves as an outline for the figure and, at the same time, acts as a barrier to prevent overflow and intermingling of the various colors. On the other hand, numeral 2 represents a mixture of a water-insoluble ink containing various water-soluble latent coloring materials, such as water-soluble aniline coloring materials ground therein, so as to mask the various colors of the soluble aniline coloring materials.

Figure 2:
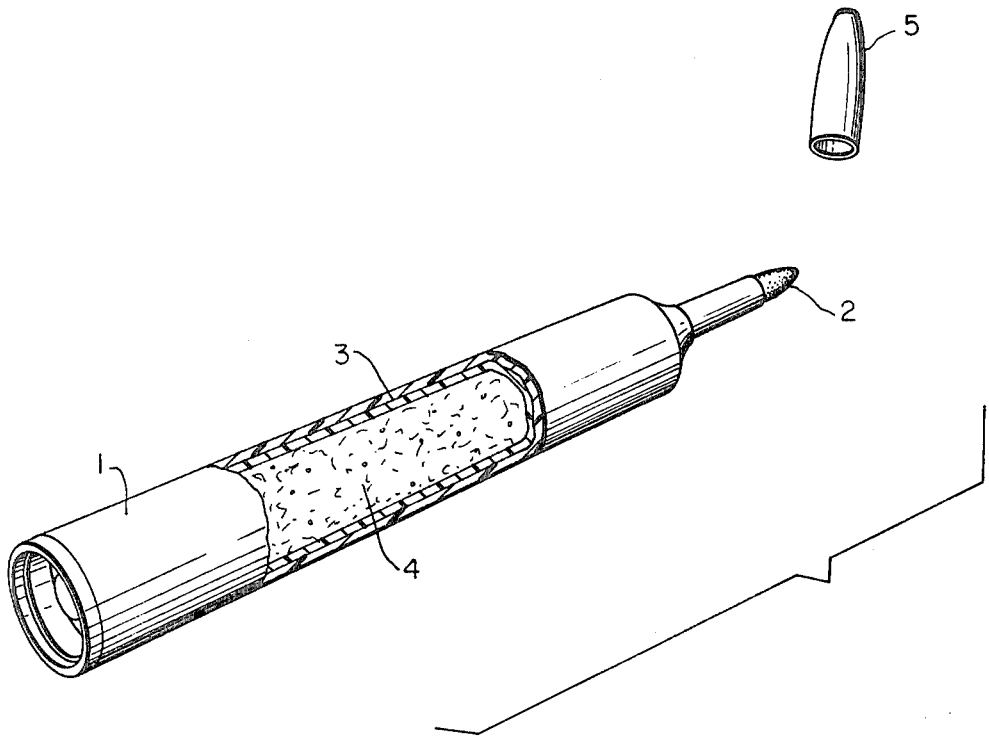
FIG. 2 is the felt tip marker pen containing a water solution therein used to mark the cartoon-like figure in FIG. 1, so as to activate the invisible coloring substance in the dotted area.

FIG. 2 represents a felt tip marking pen typically used in the present invention to activate the water-soluble coloring material or materials within the dotted areas of FIG. 1. This felt tip marker is made of a tubular hollow plastic holder (1) closed at one end and having a felt tip (2) at the other end. The tubular hollow holder contains a water solution therein. In a preferred embodiment, as depicted in FIG. 2, the hollow tubular holder contains a rigid tubular cartridge (3) made of a plastic material such as polyethylene, open at both ends, and containing an absorbent material (4) such as cotton or gauze packed into the cartridge and saturated with a water solution preferably containing a water evaporation inhibitor mixed with water. This cartridge fits into the tubular holder and is snugly held between the closed end of the hollow tubular holder and the back end of the felt tip which protrudes into the tubular holder. Thus, the felt tip (2) is always in contact with the saturated absorbent material in the cartridge so that the water solution is conveyed by a type of capilliary action to the felt tip such that the water solution is carefully metered out and deposited on the surface of the magic coloring picture, during the coloring operation. The felt tip marking pen also preferably comprises a cover 5 (preferably made of a plastic material) shown in FIG. 2 to help prevent evaporation of the water solution. Of course, the design of the pen may be varied, the essential point being that the pen contains a water solution within the hollow tubular holder capable of being metered out through a porous tip onto the picture in such amounts as to release the water-soluble colors on the surface of the picture without producing pools of water on the picture surface.

In coloring the picture in FIG. 1, it is only necessary to rub the felt tip marker of FIG. 2 over the area to be colored and the water contained within the tubular holder 1 is metered out through the felt tip in amounts sufficient to activate the various hidden colors within the dotted areas. This transformation of colors is seen as "magic" by a small child, since as pointed out before, the substance within the drawing and the solution contained in the marker are colorless.

The picture and felt tip marker combination in the present invention are conveniently arranged in package form by enclosing both the magic pictures and the felt tip marker in a suitable package, such as a paper wrapper or cardboard receptacle. Indeed, the package can contain several loose printed pictures of various different designs of the type generally illustrated by FIG. 1, in combination with a felt tip marker, or alternatively, the various pictures can be bound in a coloring book form and sold in conjunction with the felt tip marker pen in a convenient package. In this connection, it must be emphasized that the drawing in FIG. 1 illustrates only one example of the cartoon-like character to be colored with the felt tip marker of the present invention and similarly, the pen represents only one embodiment of the various designs of felt tip marker which could be employed. Further, it should be emphasized that the present invention is not confined to the water-soluble aniline dyes described above, but any water-soluble coloring materials capable of being activated by water or a water solution may be employed. In other words, the above embodiments of FIGS. 1 and 2 are only examples of the picture and felt tip marking pen which can be employed herein.

Although the object of the present invention primarily involves a package combination of a magic picture and felt tip marker pen combination, the present invention also contemplates a felt tip marker pen filled with a water solution to be used and sold separately and which is designed to be ultimately used in conjunction with a magic picture. This pen is illustrated in FIG. 2 of the drawings as described above.

The coloring combination package of the present invention, besides affording excellent amusement to a child, is also an important educational tool in that it teaches color recognition and, at the same time, teaches the child control and coordination of the small muscles by learning to color within the lines designated in the various areas of the picture.

The advantages of the present invention over that of the prior art are multiform. Thus, according to the present invention, the water is housed within the felt tip marker and one does not need to use an external water source to paint the picture. This means that the package combination can be given to a child for amusement for long automobile rides or airplane trips where water is either unavailable or the use of an external water source, such as water within a basin or receptacle, would be too messy and impractical to be used. As far as the inventor knows, such a felt tip pen containing a water solution housed within the holding cavity and such magic picture coloring package has not been known up to the present invention.

Further, the use of water or a water solution within the pen itself enables one to color accurately within the figure without splashing the water all over the drawing because the water is metered out in small amounts to activate the invisible coloring substance without forming pools of smeared water colors on the paper.

Finally, according to the present invention, the water within the felt tip pen housing preferably contains a water evaporation inhibitor, which inhibitor prevents evaporation of the water solution. This means that the pen can be used for a long duration of time to color several figures without drying up. Typical evaporation inhibitors which can be employed are various glycols, such as propylene or dipropylen glycol or butylene glycol.

It can be seen from the above that the use of the felt tip marker containing water therein and the picture-pen combination of the present invention greatly expands the practical use of such magic coloring device and is much more practical and convenient than the typical applicatorpicture combination previously known, wherein an external water source had to be employed.

What is claimed is:

1. A coloring package combination comprising:

invisible coloring pictures which are each outlined in a water-insoluble ink defining various areas therein, said areas having printed therein a mixture of a water-insoluble ink of a uniform color and a variety of water-soluble coloring materials of different colors located at certain predetermined portions of the picture, said water-soluble coloring materials being thoroughly mixed with the water-insoluble ink to such an extent that the water-soluble colors are hidden from sight within the water-insoluble uniformly colored ink;

a single felt tip marking pen comprising a tubular hollow holder enclosed at one end and comprising a felt tip located at the other end, said tubular holder containing therein a liquid selected from the group consisting of water and a solution of water with a water evaporation inhibitor within the hollow portion and in contact with the felt tip, said felt tip pen being used to activate the water-soluble colors by rubbing the felt tip of the pen across the various areas in the picture thereby depositing the water located within the tubular saturated pen holder through the felt tip to the picture surface so as to release the colors from the water-soluble ink said water being metered out of the pen in such small amounts as to enable one to color accurately without splashing water onto the picture and forming pools of smeared water colors thereupon; and, a wrapper to house the pictures and felt tip marker into a single package.

2. The coloring package combination of claim 1, wherein the pictures are composed of a series of loose sheets of paper containing various prints thereon.

3. The coloring package combination of claim 1, wherein the pictures are composed of different designs bound together in the form of a coloring book.

4. The coloring package combination of claim 1, wherein the various areas within the pictures are printed with a pattern of dots of a uniform color made up of the water-insoluble ink and the water-soluble coloring material.

5. The coloring package combination of claim 4, wherein the dots are black.

6. The coloring package combination of claim 1, wherein the water-soluble coloring material is an aniline dye.

7. The coloring package combination of claim 1, wherein the water solution located within the felt tip pen holder contains a water evaporation inhibitor therein.

8. The coloring package combination of claim 1, wherein the felt tip pen also contains a cover to fit over the felt tip.

9. The coloring package combination of claim 1 wherein said tubular holder contains water therein.

10. The coloring package combination of claim 1 wherein the tubular hollow holder contains a rigid tubular plastic cartridge therein containing an absorbent material saturated with a liquid selected from the group consisting of water and a solution of water and a water evaporation inhibitor, said cartridge being held snugly between the enclosed end of the tubular holder and the end of the felt tip which protrudes into the tubular holder so that the felt tip is always in contact with the saturated absorbent.

11. The coloring package of claim 1 wherein the absorbent is selected from the group consisting of cotton or gauze.

* * * * *